United States Patent [19]

Straubel et al.

[11] Patent Number: 4,768,719

[45] Date of Patent: Sep. 6, 1988

[54] FUEL INJECTION NOZZLE FOR INTERNAL COMBUSTION ENGINES

[75] Inventors: Max Straubel; Ewald Eblen, both of Stuttgart; Paul Füssner, Sindelfingen; Günter Kapolke, Geisfeld; Edgar Schneider, Knetzgau; Klaus Wolf, Stuttgart; Werner Wagner, Gerlingen; Karl Hofmann, Remseck, all of Fed. Rep. of Germany

[73] Assignee: Robert Bosch GmbH, Stuttgart, Fed. Rep. of Germany

[21] Appl. No.: 90,152

[22] PCT Filed: Nov. 7, 1986

[86] PCT No.: PCT/DE86/00453

§ 371 Date: Jul. 17, 1987

§ 102(e) Date: Jul. 17, 1987

[87] PCT Pub. No.: WO87/03339

PCT Pub. Date: Jun. 4, 1987

[30] Foreign Application Priority Data

Nov. 21, 1985 [DE] Fed. Rep. of Germany ..... 3541131
Mar. 29, 1986 [DE] Fed. Rep. of Germany ..... 3610658

[51] Int. Cl.[4] ..... F02M 61/20
[52] U.S. Cl. ..... 239/533.4; 239/533.9
[58] Field of Search ..... 239/533.3–533.12, 239/452, 453

[56] References Cited

U.S. PATENT DOCUMENTS

| | | | |
|---|---|---|---|
| 4,168,804 | 9/1979 | Hofmann | 239/533.11 |
| 4,285,471 | 8/1981 | Eblen et al. | 239/533.4 |
| 4,403,740 | 9/1983 | Eblen et al. | 239/533.8 X |
| 4,566,635 | 1/1986 | Trachte | 239/533.8 |
| 4,684,067 | 8/1987 | Cotter et al. | 239/533.8 X |

FOREIGN PATENT DOCUMENTS

| | | | |
|---|---|---|---|
| 1284687 | 12/1968 | Fed. Rep. of Germany | 239/533.7 |
| 2711393 | 9/1978 | Fed. Rep. of Germany . | |
| 350835 | 1/1961 | Switzerland . | |
| 2093118 | 8/1982 | United Kingdom . | |
| 2128252 | 4/1984 | United Kingdom . | |

*Primary Examiner*—Andres Kashnikow
*Assistant Examiner*—Mary Beth O. Jones
*Attorney, Agent, or Firm*—Michael J. Striker

[57] ABSTRACT

Fuel injection nozzle for internal combustion engines includes a first closing spring which acts continuously on the valve needle by means of a central pressure pin and, in addition, a second closing spring which acts continuously on the valve needle by means of a pressure piece after covering the distance of an initial stroke. The pressure piece is supported at the nozzle body by means of an intermediate bush during the initial stroke. The initial stroke is limited by means of the shoulders at the valve needle and the intermediate bush, whereas the total stroke is limited by means of the shoulders at the intermediate bush and the intermediate disk. Accordingly, the initial stroke can be adjusted very accurately to a desired magnitude merely by means of grinding the valve needle and does not change during the assembly of the injection nozzle.

5 Claims, 1 Drawing Sheet

FUEL INJECTION NOZZLE FOR INTERNAL COMBUSTION ENGINES

BACKGROUND OF THE INVENTION

The invention relates to a fuel injection nozzle. In known injection nozzles of this generic type the shoulders which limit the initial lift of the valve needle are formed at the pressure pin of the first closing spring and at the pressure piece of the second closing spring. In this construction the tolerance range of the initial lift is determined by means of manufacturing tolerances at the nozzle body and the valve needle as well as at the pressure pin and the intermediate disk, so that it is necessary to adjust the initial lift by means of adapting the pressure pin. However, because of the large number of individual manufacturing tolerances and the deformation during assembly, the initial lift tolerance can be maintained only within a relatively large range of e.g. 0.05 mm, which is too large for many uses. With very small initial lifts, as are required for directly injecting engines, the tolerance range of the initial lift must be clearly smaller than the aforementioned magnitude given by way of example.

SUMMARY OF THE INVENTION

In contrast, the arrangement, according to the invention has the advantage that the tolerance range of the initial lift is determined only by means of manufacturing tolerances at the nozzle body and the nozzle needle. The initial lift can therefore be accurately measured and adjusted by means of grinding the valve needle. Moreover, dimensional tolerances or changes in other parts occurring during operation or during assembly no longer have an effect on the magnitude of the initial lift.

A construction which is particularly simple and suitable for manufacturing results if the shoulder limiting the initial lift is formed at the intermediate bush on its planar front side facing the nozzle body, which front side is pressed against an area of the upper, likewise planar front side of the nozzle body through the action of the second closing spring, which area is not covered by the intermediate disk.

The total lift of the valve needle can be adjusted in a simple manner if the intermediate disk is formed of two individual disks, that intermediate disk which adjoins the nozzle body having a larger borehole diameter than the other, and if the shoulder for limiting the total lift of the valve needle, which shoulder is formed at the intermediate disk, is formed at the area of the front side of the individual disk, which area is not covered by the other individual disk. In this construction, the total lift is determined by means of the thickness of the individual disk adjoining the nozzle body, so that only one individual disk of suitable thickness need be provided in order to obtain the desired total lift.

The intermediate bush can preferably be guided on a pressure peg of the valve needle, which also results in a guiding of the pressure pin of the first closing spring. In many cases, however, it can also be advantageous to construct the valve needle without pressure pegs and to guide the intermediate bush in the intermediate disk. In this arrangement the front side of the valve needle can be particularly simply treated and, moreover, pressure peg breakage is prevented at the valve needle.

The novel features which are considered as characteristic for the invention are set forth in particular in the appended claims. The invention itself, however, both as to its construction and its method of operation, together with additional objects and advantages thereof, will be best understood from the following description of specific embdiments when read in connection with the accompanying drawings.

DETAILED DESCRIPTION OF THE PREFERRED EMBODIMENTS

Figure 1:
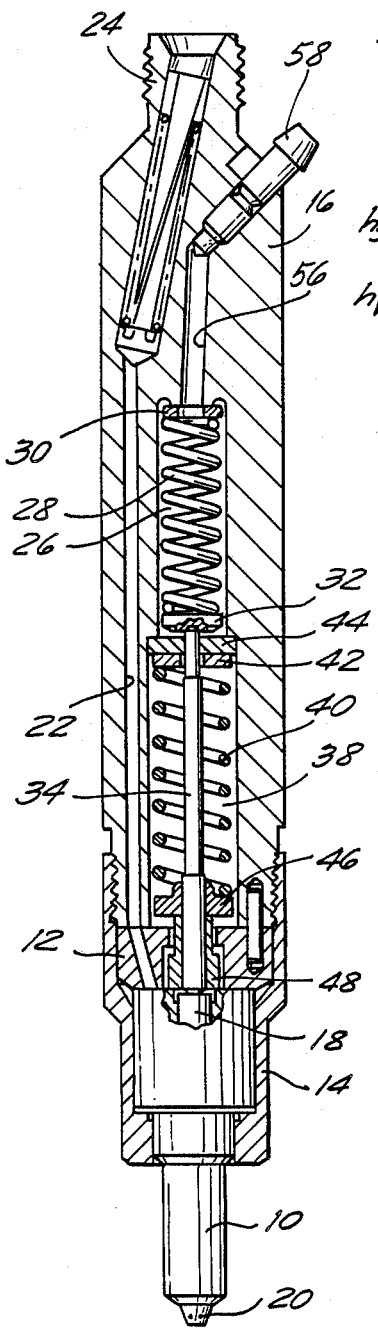
FIG. 1 shows a fuel injection nozzle in longitudinal section.

The injection nozzle according to FIG. 1 has a nozzle body 10, which is tightened on a retaining member 16 together with an intermediate disk 12 by means of a cap nut 14. A valve needle 18, which cooperates with an inwardly directed valve seat in the nozzle body 10, is supported in the nozzle body 10 so as to be displaceable, a plurality of spray openings 20 being accommodated in the front of the valve seat. The guide borehole of the valve needle 18 is, as usual, widened at one place to form a pressure space, in whose area the valve needle 18 has a pressure shoulder and which is connected with a connection piece 24 at the retaining member 16 via a duct 22 for connecting a fuel delivery line. The fuel acting at the pressure shoulder of the valve needle 18 pushes the valve needle 18 upward against the gradual force of a closing spring arrangement, described in the following, wherein the fuel is sprayed out through the spray openings 20 in a preliminary injection phase and a main injection phase.

Figure 2:
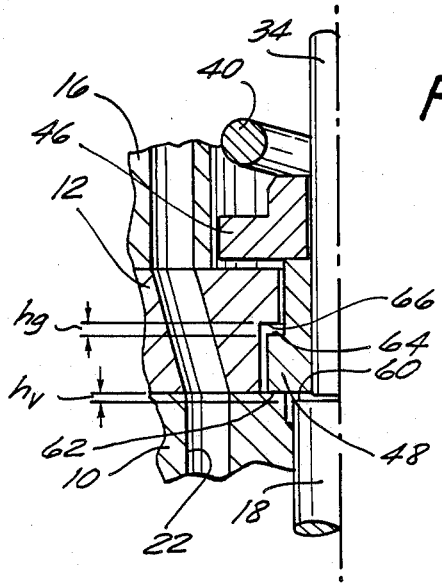
FIG. 2 shows portions of the injection nozzle according to FIG. 1 in enlarged view and FIG. 3 shows a variant of the construction, according to FIG. 1.

A first chamber 26 for receiving a first closing spring 28 is formed in the retaining member 16, the first closing spring 28 being supported at the base of the chamber 26 by means of a disk 30 and acting continuously on the valve needle 18 by means of a pressure piece 32 and a pressure pin 34. At a housing shoulder 36, the chamber 26 passes into a second chamber 38 in which is arranged a second closing spring 40 which encloses the pressure pin 34. The closing spring 40 is supported at the housing shoulder 36 by means of disks 42, 44 and acts on a pressure piece 46 which is supported on the pressure pin 34 so as to be displaceable. The pressure piece 46 is supported at an area 50 (FIG. 2) of the upper front side 52 of the nozzle body 10 by means of an intermediate bush 48 which is constructed as a separate part, which area 50 is not covered by the intermediate disk 12. The chambers 26 and 38 are connected with a connection nipple 58 for an overflow oil line via a duct 56.

During the injection process the valve needle 18 executes an initial lift or stroke $h_v$ in which only the first closing spring 28 is effective as a counterforce. A defined preliminary injection quantity is injected into the combustion chamber of the engine. The initial lift or stroke $h_v$ is concluded when the upper front side 60 of the valve needle 18 comes to rest on the lower front side 62 of the intermediate bush 48. The valve needle 18 remains in this position until the fuel pressure, which continues to increase, overcomes the counterforces of the two closing springs 28 and 40. The valve needle 18, together with the intermediate bush 48, is then moved further in the opening direction by the distance $h_g$ until it has traveled its total stroke. The latter is limited and determined by means of the ring shoulders 64, 66 at the intermediate bush 48 and the intermediate disk 12. At the ring shoulder 64, a portion 68 of the intermediate bush 48 having a larger diameter passes into a portion 70 which has a smaller diameter and which is guided in the intermediate disk 12 and, in turn, guides the central pressure pin 34.

In the injection nozzle, according to the invention, the initial stroke $h_v$ can be measured easily. For this purpose, the valve needle 18 need only be inserted in the nozzle body 10 until it rests at the valve seat and the difference in height between the upper front side 52 of the nozzle body 10 and the front side 60 of the valve needle 18 is measured. In addition, the desired dimensioning of the initial stroke $h_v$ can be very accurately produced by means of grinding the front side 60 of the valve needle 18. No changes in the initial lift $h_v$ occur during the assembly and during the operation of the injection nozzle.

Figure 3:
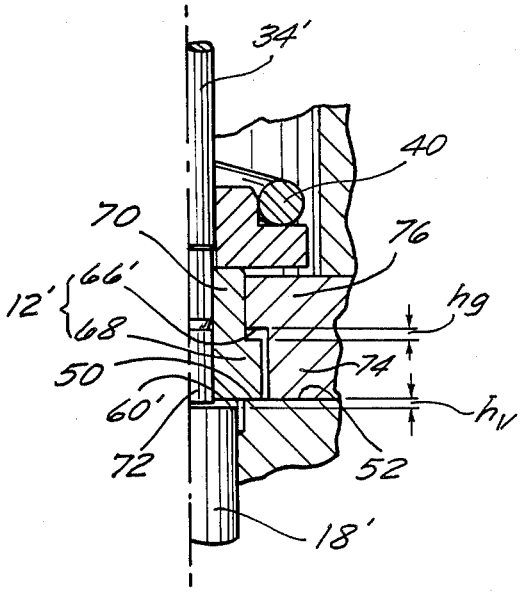

In the embodiment according to FIG. 3, a pressure pin 72 is formed on the valve needle 18, the intermediate bush 48 being guided at the pressure pin 72 and the force of the first closing spring 28 being transmitted to the valve needle 18' via the pressure pin 72. The intermediate disk 12' is formed from two individual disks 74, 76, the lower one having a larger inner diameter than the upper one. The shoulder for defining the total stroke of the valve needle 18' is formed by means of the area 66' of the upper individual disk 76, which area 66' is not covered by the lower individual disk 74. In this contruction, the total stroke can also be easily adjusted to the desired value by means of a corresponding selection of the thickness of the individual disk 74.

It will be understood that each of the elements described above, or two or more together, may also find a useful application in other types of fuel injection nozzles differing from the types described above.

While the invention has been illustrated and described as embodied in a fuel injection nozzle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a fuel injection nozzle for internal combustion engines, comprising a nozzle body in which a valve needle is supported so as to be displaceable; a nozzle retainer; an intermediate disk positioned between said nozzle body and said nozzle retainer; means connecting said nozzle body, said intermediate disk and said nozzle retainer to each other; the nozzle retainer having a chamber receiving a first and a second closing springs; a central pin and a pressure piece both positioned in said chamber, the first of said springs acting continuously on the valve needle via said central pin, whereas the second closing spring acts on said pressure piece; the valve needle upon being displaced firstly covering a distance of an initial stroke, said valve needle having a countershoulder which moves therealong, said intermediate disk having a shoulder which limits a total stroke of the valve needle; the improvement comprising an intermediate bush (48), the pressure piece (46) due to the action of the second closing spring (40) acting on said intermediate bush (48) which is constructed as a separate structural component part from the pressure piece (46) and which penetrates the intermediate disk (12) and is supported at a shoulder (50) formed on the nozzle body (10) until the valve needle has traveled the initial stroke; and wherein said intermediate bush has at a side thereof which faces said needle a first shoulder (62) which forms with said countershoulder (60) of said needle a first pair of shoulders (60, 62) provided to limit the initial stroke of said valve needle and a second shoulder (64) which forms with said shoulder (66) of said intermediate disk a second pair of shoulders (64, 66) provided to limit the total stroke of said valve needle.

2. Injection nozzle according to claim 1, wherein said first shoulder formed on the intermediate bush (48) is pressed against an area (50) of an upper, planar front side (52) of the nozzle body (10) by the action of the second closing spring (40), said area (50) not being covered by the intermediate disk (12).

3. Injection nozzle according to claim 1, wherein the intermediate disk (12') is formed by two individual disks (74, 76) each having a borehole which receives said intermediate bush, a first of said disks being supported on the nozzle body (10) having the borehole of a larger diameter than that of a second one of said disks (76), and wherein one of the shoulders (66') for defining the total stroke is formed at an area of the second disk (76), said area not being covered by the first disk (74).

4. Injection nozzle according to claim 1, wherein the intermediate bush (48) is guided on a pressure pin (72) which is integral with the valve needle (18') so as to be displaceable therewith.

5. Injection nozzle according to claim 2, wherein the intermediate disk (12') is formed by two individual disks (74, 76) each having a borehole which receives said intermediate bush, a first of said disks (74), being supported on the nozzle body (10), having the borehole of a larger diameter than that of a second disk (76), and wherein one of the shoulders (66') for defining the total stroke is formed at an area of the second disk (76), said area not being covered by the first disk (74).

* * * * *